United States Patent [19]

Corder

[11] 4,266,887

[45] May 12, 1981

[54] SELF-ELEVATING FIXED PLATFORM

[75] Inventor: Paul R. Corder, Baytown, Tex.

[73] Assignee: Brown & Root, Inc., Houston, Tex.

[21] Appl. No.: 805,326

[22] Filed: Jun. 10, 1977

[51] Int. Cl.[3] ..... E02B 17/02; E02B 17/08

[52] U.S. Cl. ..... 405/196; 405/208; 405/224

[58] Field of Search ..... 61/87, 88, 89, 90, 91, 61/92, 94, 95, 96, 97, 98, 99; 405/195, 196, 197, 199, 200, 203, 204, 205, 207, 208, 224, 226

[56] References Cited

U.S. PATENT DOCUMENTS

| | | | |
|---|---|---|---|
| 2,352,370 | 6/1944 | Carruthers | 61/96 |
| 2,581,098 | 1/1952 | Guenzel | 61/97 |
| 2,622,404 | 12/1952 | Rice | 405/207 |
| 2,637,978 | 5/1953 | Evans | 61/94 |
| 2,837,987 | 6/1958 | Nedderman | 61/92 |
| 2,997,852 | 8/1961 | Suderow | 405/201 |
| 3,044,269 | 7/1962 | Le Tourneau | 61/91 |
| 3,390,531 | 7/1968 | Johnston et al. | 61/94 |
| 3,433,024 | 3/1969 | Diamond et al. | 61/90 |
| 3,479,828 | 11/1969 | Luque | 405/224 |
| 3,699,688 | 10/1972 | Estes | 61/91 |
| 3,807,316 | 11/1961 | Higgins, Jr. | 61/91 |
| 3,828,561 | 8/1974 | Moore et al. | 61/91 |
| 3,896,628 | 7/1975 | Hansen | 61/99 |
| 3,927,535 | 12/1975 | Giblon | 61/91 |

FOREIGN PATENT DOCUMENTS

| | | | |
|---|---|---|---|
| 2442186 | 3/1976 | Fed. Rep. of Germany | 61/92 |
| 7413413 | 4/1975 | Netherlands | 61/90 |
| 991247 | 5/1965 | United Kingdom | 61/90 |

*Primary Examiner*—David H. Corbin

*Attorney, Agent, or Firm*—Kenway & Jenney

[57] ABSTRACT

A mobile offshore platform and method of fabrication are disclosed. The platform features a deck member, a base member, leg structures interconnecting the two members, and means for varying the distance between the members. The leg structures are secured to the base and are preferably spaced around the periphery of the work area at the vertices of a regular polygon to provide a deck member having a large, substantially obstruction-free, work area. The legs are also connected to the base member to provide a force resistant to vertical flexing of the base member, and to distribute more uniformly the loading of the base member. The base member is adapted to store petroleum products. A multi-tiered embodiment for deep water work is also disclosed.

46 Claims, 26 Drawing Figures

SELF-ELEVATING FIXED PLATFORM

This invention relates to offshore platform assemblies and methods for fabricating them and more particularly, the invention relates to a mobile offshore platform assembly which may be floated into position at an installation site.

BACKGROUND OF THE INVENTION

The use of and demand for offshore platforms has grown tremendously in recent years as the demand for new oil and gas supplies has increased. To meet the demand for platforms in different environmental conditions, many different structures and fabrication methods have been proposed and used; and each new generation of structures has generally provided greater stability and safety.

Stability and safety in offshore platforms has not come cheaply however. In efforts to reduce the cost of offshore installations, there have been proposed various types of mobile platforms, platform assemblies which may be moved, either under their own power or under tow, to an offshore installation site. There, the offshore platform is installed, used, and at the end of its utility at the site, may be refloated and moved to a new site. Thus the capital cost of the platform may be spread over several sites.

While mobile offshore platforms have been considered by some as the way of the future in many applications, their design has been in but the preliminary stages. Thus, many previously proposed mobile platforms have a platform or deck structure which is of limited usefulness because of obstructions in the work area. The obstructions are generally associated with the equipment required to raise and/or lower the deck relative to a stable gravity base unit. The base rests on the seabed in normal operation. Other units are either difficult to construct or are overly expensive; and yet other units do not provide the stability necessary for many applications.

Additionally, existing mobile platforms, which may be floated to the site, have generally not been useful at depths below 250–350 feet. Therefore, as the need to venture into deeper waters continues to grow, the mobile platform has not heretofore been considered a viable alternative and thus the more expensive fixed platform must be used or adapted to the greater depths.

It is therefore an object of the invention to provide mobile offshore platform assemblies and methods of fabrication which are relatively inexpensive, have improved stability, and are capable of operating at from shallow depths up to depths of 1500 feet or more. Other objects of the invention include providing a mobile offshore platform assembly wherein the assembly may be fabricated onshore and floated to the installation site, wherein derrick barges are not required to install the platform assembly and wherein the means for spacing the deck portion of the assembly relative to the base portion of the assembly are commercially available and are reuseable from one installation site to another.

Other objects of the invention include a base member which can be used for oil storage, a platform assembly which can be salvaged and reused, and an assembly wherein operations can be commenced very quickly after base grouting has been completed.

Still other objects of the invention are a platform design wherein the various components of the platform assembly can be highly standardized and optimized, and wherein quality control during fabrication of the platform can be greatly increased by producing the components under controlled conditions.

Yet another object of the invention is to provide a platform assembly which can be equipped and tested prior to being towed to the installation site.

Still another object of the invention is to provide a platform assembly wherein the load is substantially uniformly distributed throughout the base member.

SUMMARY OF THE INVENTION

The Generic Structure

The invention features a mobile, offshore platform assembly which comprises a base member having a fluid-tight compartment, the base member having sufficient buoyancy, when the fluid-tight compartment is filled with gas, to be the prime buoyancy element of the platform assembly to thereby support the assembly during tow to the installation site. The platform also has means for adapting the fluid-tight compartment of the base member to store fluid petroleum products. A deck member and a plurality of open, truss-like, elongated support leg structures are interconnected using a plurality of jack elements secured to the deck member and oriented to engage respective cooperating elements on the legs. The jack elements are adapted to vary the spacing between the deck and the base. The leg structures are permanently secured to the base member and have a substantially vertical orientation. The legs are connected to the base member to provide a force resistant to vertical flexing of the base member and to better distribute the load and forces to which the base is subjected.

The Pass-Around Structure

In this aspect, the invention features truss-like leg structures wherein each intersects a plane defined by an upper work surface at positions outside or not intersecting the work surface defined by said deck. The jack elements are therefore secured around an outside periphery of the deck member and engage the respective leg structure substantially at the periphery. A plurality of lateral support means, preferably skirt frames, are attached to the peripherally located support legs and spaced away from the deck to permit the deck to move in a non-interfering relationship with said support means. The support means provides a force resistant to lateral movement of the leg structures.

The Pass-Through Structure

In another aspect of the invention, the skirt frames cannot be used and in their place, the invention features a plurality of elongated open, truss-like, side stays connected between the base member and the leg structures to provide a force resistant to lateral movement of the leg structures. The stays have a docking connection with the leg structures and the base whereby the stays are moveable from a first condition wherein they are in a non-interfering relationship to movement of the deck member along the leg structures and to a second condition wherein they support the leg structures against lateral movement and are in an interfering relationship to movement of the deck member along the leg structures. The deck work surface is substantially obstruction-free.

The Deep Water Multi-Tiered Structure

In another particular embodiment of the invention, particularly useful in deep water locations, there is featured a multitiered, mobile, offshore platform assembly comprising a base member having a fluid-tight compartment, a deck member, at least one intermediate member, each member being arranged in a plane parallel to the deck member, a plurality of interconnecting open truss-like, elongated support leg structures permanently secured to the base member, and at least one group of second support leg structures, the number of groups of second leg structures being equal to the number of intermediate members, and each group being permanently secured to a different intermediate member. Each of the support leg structures has a substantially vertical orientation.

The invention further features in this particular embodiment at least one group of jack elements secured to the intermediate member closest to the base member. The jack elements are oriented to engage respectively first cooperating elements on the first support leg structures, and are adapted to support the closest intermediate member in a spaced apart relationship to the base member and to vary the spacing between the closest intermediate member and the base member. Each other intermediate member and the deck member each have means for receiving the jack elements and to secure them to the member in an orientation to engage respectively cooperating elements on the second support leg structures of the next lower intermediate member. The received jack elements would be adapted to support the member in a spaced apart relationship to the next lower intermediate member and to vary the spacing between the member and the next lower intermediate member. Thereby, the base member can be lowered to engage a submerged water bottom and the deck member can be raised above the water surface level. Each intermediate member is thereby submerged beneath the water surface at an intermediate water depth between the deck and base members.

The Generic Fabrication Method

The invention further features a method of fabricating a mobile offshore platform assembly which can be floated to an installation site from an onshore platform fabrication facility. The invention features the steps of fabricating a base member having a fluid-tight compartment, fabricating a deck member, and positioning the deck member into an operational relationship with a top surface portion of the base member at a predefined location. The deck member is provided with a plurality of jack elements secured thereto which cooperatively engage each of a plurality of open, truss-like elongated support leg structure sections. A plurality of leg structures are fabricated from the leg sections as follows. A plurality of partial leg structures are engaged by the jack elements and additional leg sections are secured to each partial leg structure to form longer partial leg structures. The deck is positioned relative to the partial leg structures, using the jack elements, and aids in securing additional leg sections to the partial leg structures. The deck is returned to a position adjacent the base member after the leg structures are completed. The resulting mobile offshore platform assembly is ready to be towed to the installation site.

The High Platform Fabrication Method

In one aspect, the invention features a method of fabricating a mobile offshore platform assembly wherein the leg structure fabricating step includes the steps of engaging a plurality of partial leg structures with the jack elements and securing another leg section to each topmost leg section at its top portion to form a longer partial leg structure. The deck is raised on the partial leg structures using the jack elements and aids in securing additional leg sections to topmost portions of the partial leg structures. The deck is returned to a position adjacent the base member after the leg structures are completed, whereupon deck equipment is installed and tested. The resulting mobile offshore platform assembly is ready to be towed to the installation site.

The Low Platform Fabrication Method

In an alternative fabrication method, the leg structure fabricating step includes the steps of engaging a plurality of partial leg structures with the jack elements; raising said deck on said partial leg structures, using said jack elements, a distance at least equal to the length of a leg section; providing a plurality of temporary support structures beneath the deck member; positioning and supporting the deck member on the temporary support structures; raising the partial leg structures, using the jacks, a distance at least equal to the length of the leg sections, while maintaining the deck in a stationary position with respect to the base member; successively adding and securing additional leg sections to the bottommost portion of the partial leg structures and raising the resulting partial leg structures thereafter, whereby additional leg sections can be added and secured to the partial leg structures until the leg structures are complete. The invention features the further steps of securing the bottommost leg sections to the base member, raising the deck member above the temporary support structures using the jacks and leg structures, and removing the temporary support structures from beneath the deck member whereby the deck member may be positioned adjacent the base member.

DESCRIPTION OF THE DRAWINGS

Other objects, features and advantages of the invention will appear from the following description of particular preferred embodiments of the invention taken together with the drawings in which.

DESCRIPTION OF PARTICULAR PREFERRED EMBODIMENTS

The Generic Structure

Figure 1:
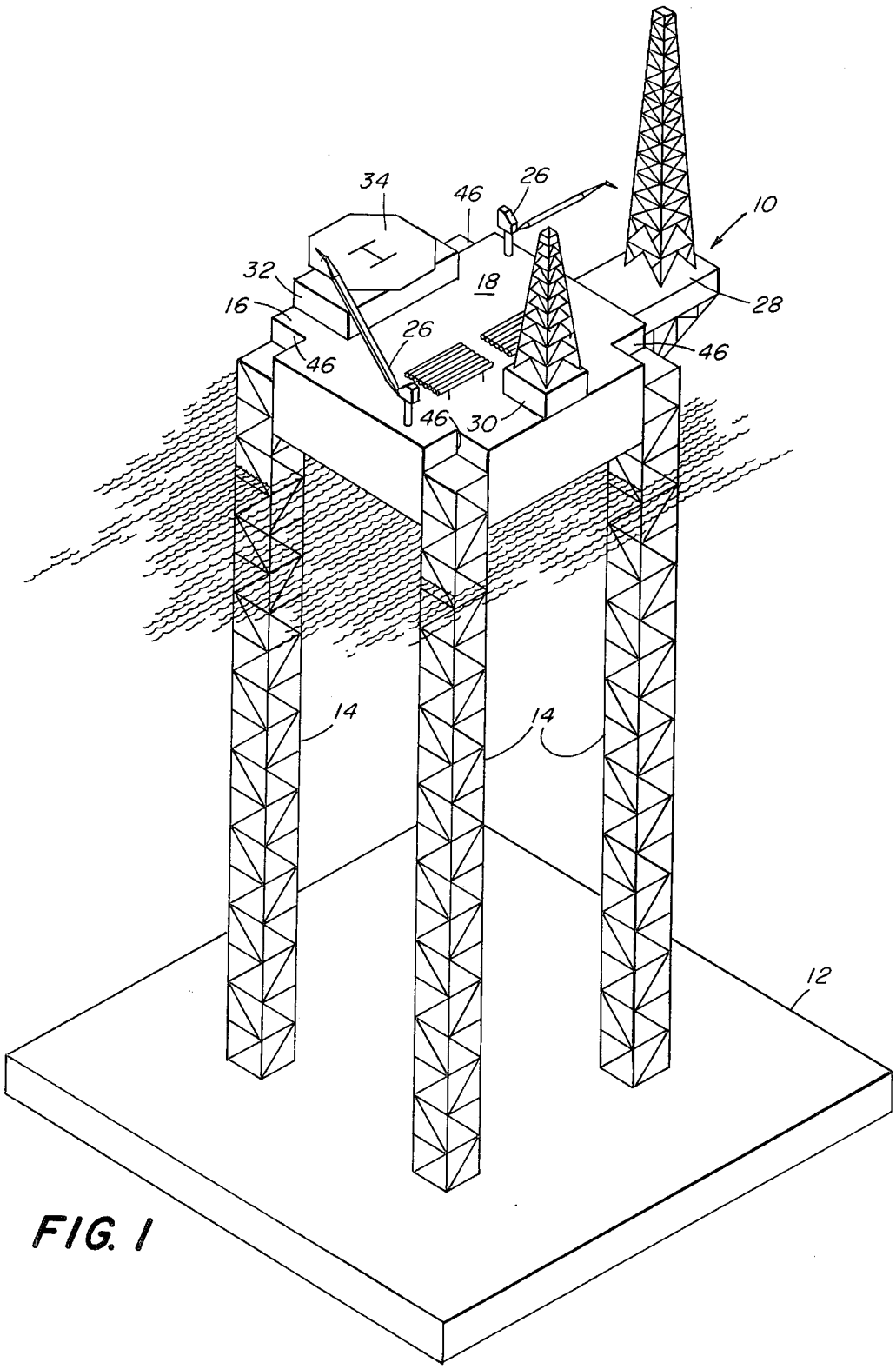
FIG. 1 is a perspective view of a basic mobile offshore platform assembly according to the invention.

Referring to FIG. 1, a mobile, offshore platform assembly 10, constructed in accordance with the invention, includes, in its simplest form, a base member 12, a plurality of supporting leg structures 14, and a deck member 16, having a work surface or area 18 on an upper side thereof. Preferably work surface 18 is a substantially uncluttered, centrally located work surface. The deck member 16 carries on its upper work surface 18 certain of the equipment needed to operate as a self-sustaining offshore facility and may have several below work surface levels, for storage and as work areas. In the particular embodiment shown, the deck member 16 carries a pair of cranes 26, a flare tower 28, a drilling rig 30, and living facilities 32 which support a helicopter landing area 34.

Figure 17:
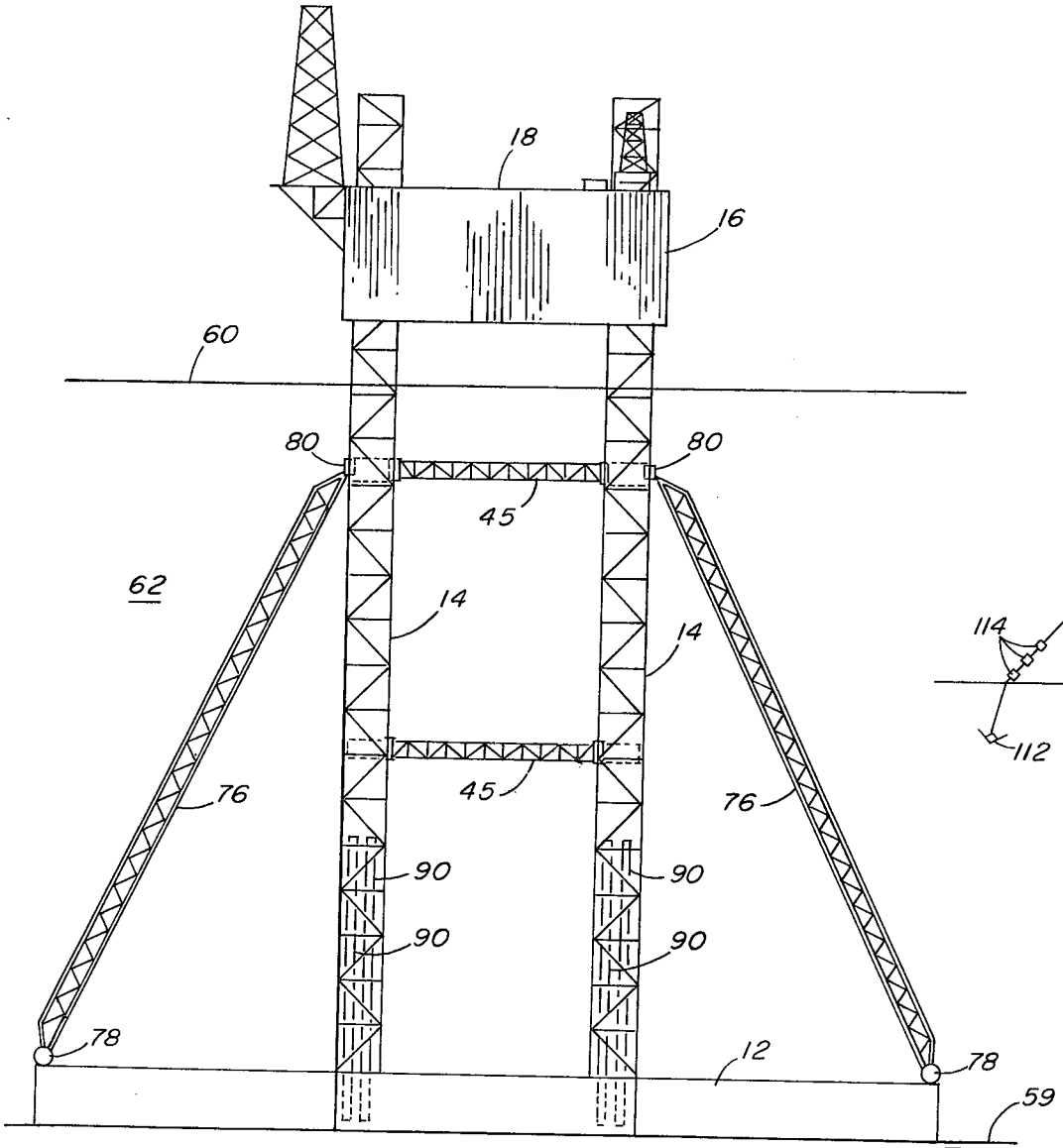

While not shown in FIG. 1, in order to maintain a clearer introduction to the invention, leg structures 14 may also be provided with lateral support means, for example, connected between base member 12 and leg structure 14, to provide the entire assembly with the additional lateral support necessary to maintain a stable, safe, and reliable structure. The lateral support members may take the form of either skirt frames 40 (FIG. 11) side stays 76 (FIG. 15), or anchored cables or guide wires 44 (FIG. 19), as described in detail below. In other embodiments the legs may be interconnected by cross members 45 (FIG. 17).

High-Platform Fabrication of the Pass-Around Structure

Figure 2:
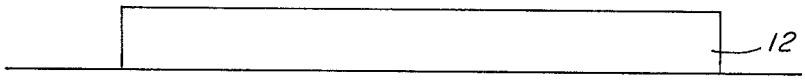
FIGS. 2–7 show in a sequence of schematic elevation views a first embodiment of a method for fabricating a mobile, offshore platform assembly according to the invention.

Referring to FIG. 2, according to a preferred embodiment of the invention, the offshore platform may be fabricated as follows. Initially, the base member 12 is fabricated in a graving dock of an onshore fabrication facility. The base member may have any configuration consistent with its function as described below. Thus the base member may have a solid rectangular configuration, as shown in FIG. 2, or it may have a barge shaped hole configuration. The base member is preferably comprised of a network of steel trusses enclosing and including at least one fluid-tight compartment (not shown) having preferably a double shell construction. Concrete may also be used. The necessary fixtures (not shown) are provided to introduce fluids into or to evacuate fluids from the compartment. For example, the compartment may be filled with gas to provide the base with a positive buoyancy or the compartment may be used to store fluid petroleum products.

The base member, when filled with a gas, will provide the prime source of buoyancy for the platform assembly when the finished platform is towed from the graving dock to the installation site. Consequently, the base member should have a sufficiently large fluid-tight compartment (or compartments) to provide the needed buoyancy. The fixtures thus enable, in the preferred embodiment, the base member 12 to be filled with a gas to attain a highly buoyant state, to be flooded with sea water to ballast it, and to provide an underwater storage facility for the fluid petroleum products after installation at the operating site. The fixtures required to provide this capability, while not shown, are however well known in the art.

Figure 3:
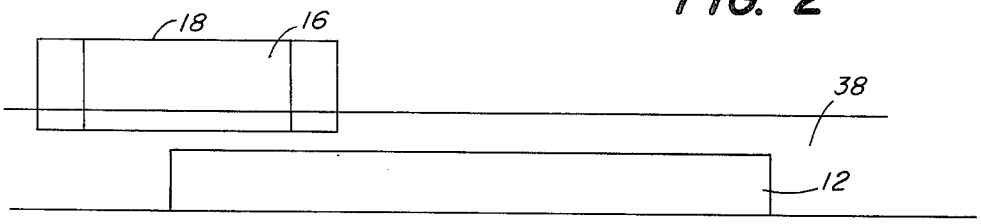
Figure 4:
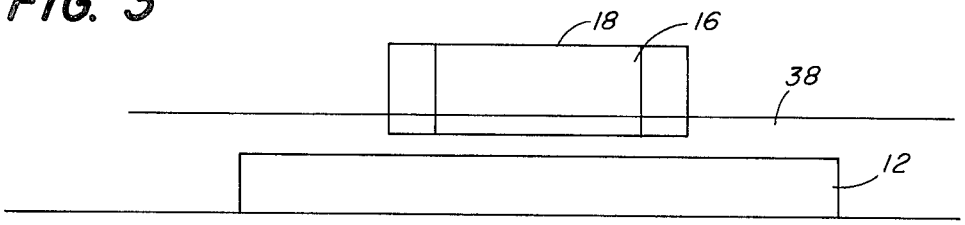
Figure 5:
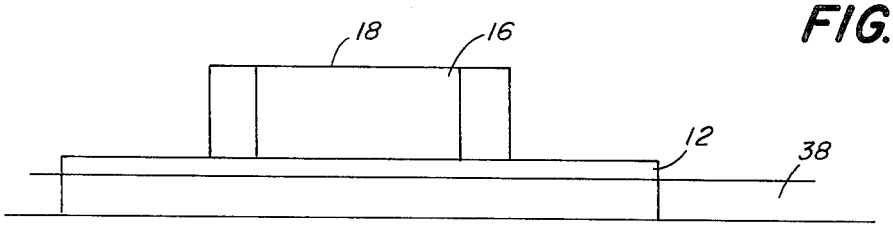

Referring to FIG. 3, the deck member 16 is fabricated, for example, at another location in the fabrication facility and is positioned in an operational relationship with the base member. Preferably, after the deck member is complete, the graving dock is flooded with water 38 and the deck is floated over the base member to a predefined alignment therewith (FIG. 4). Once in its aligned position over the base member, the graving dock is preferably deflooded to effect controlled lowering of deck member 16 onto and in contact with base member 12 (FIG. 5). In other embodiments of the invention, the deck member may be skid on rails into alignment with the base member. The deck member is preferably constructed of a steel truss network (although concrete may be used) and preferably also includes fluid storage facilities (not shown).

In a preferred embodiment of the invention, as shown in FIG. 1, the deck has a substantially square cross section which is notched at each corner 46 to provide a structurally strong connection to leg structures 14 as described below. In addition, this construction along the outside periphery of deck member 16 provides a structure which does not interfere with the free movement of the deck relative to leg structures 14 during installation. As noted above, the deck may have at least one fluid-tight compartment; and if so fabricated, the necessary fixtures (not shown) for controlling the buoyancy of the deck and/or storage for petroleum production are also provided. Once the deck is positioned on the base member (FIG. 5), construction of the supporting leg structures 14 may begin.

Figure 6:
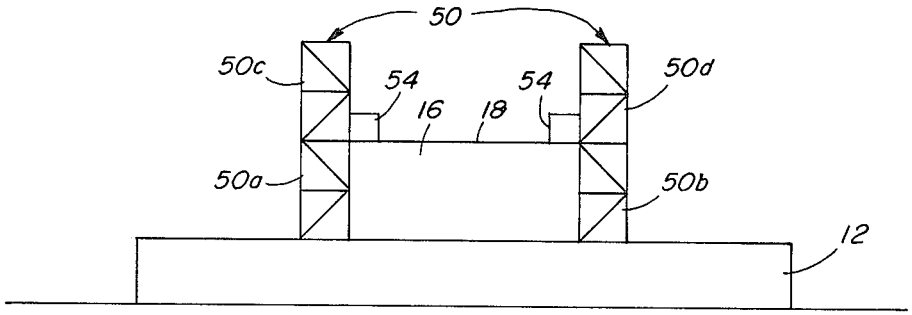

Referring to FIG. 6, supporting leg structures 14 are each fabricated by securing a plurality of leg sections 50 in an end-to-end construction. Two preferred fabrication methods are discussed hereinafter. In one fabrication embodiment, leg sections **50*a* and 50*b*, are first placed in a cooperating relationship to deck member 16 at corners 46 and are secured in a permanent manner to base member 12 in any way known in the art. For example, leg sections 50 may be welded to the base member 12. Second leg sections, 50*c*, 50*d*, are respectively secured to leg sections 50*a*, 50*b*, at their topmost surface (FIG. 6). Each leg section carries a cooperating element which is adapted to mate with jack elements 54 carried by the deck member. The jack elements 54 which are temporarily secured to the deck member may then be operated to raise or lower the deck member with respect to base member 12** using the cooperating elements of the leg sections as a running track. Preferably the means to move the leg structure is a rack and pinion arrangement.

Figure 7:
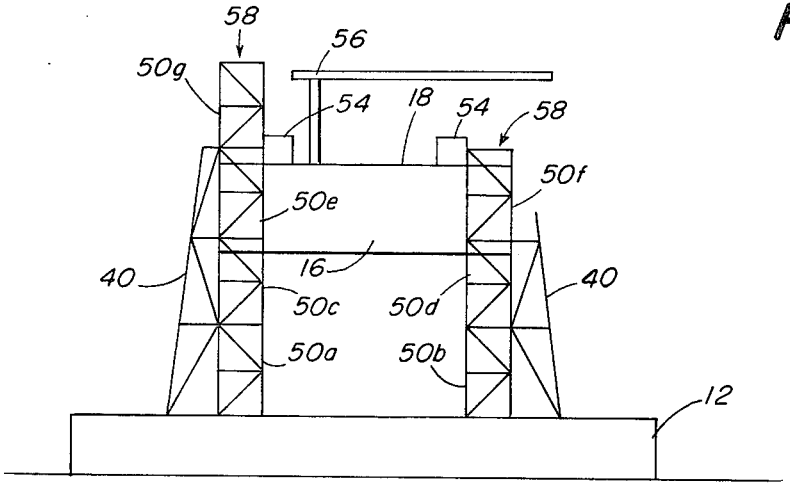

Referring to FIG. 7, after the first two leg sections, 50*a*, 50*b*, 50*c*, 50*d*, are assembled on each of the corners of deck member 16, the deck member is raised and is provided with a crane element 56. Crane 56 is adapted to aid in securing additional leg sections to the now partial leg structures 58 which have previously been formed. In addition, crane 56 also aids in fabricating the lateral support structures which provide additional lateral stability to the resulting structure. Referring particularly to FIG. 7, skirt frames 40 are provided for additional lateral stability in the resulting structure.

Figure 8:
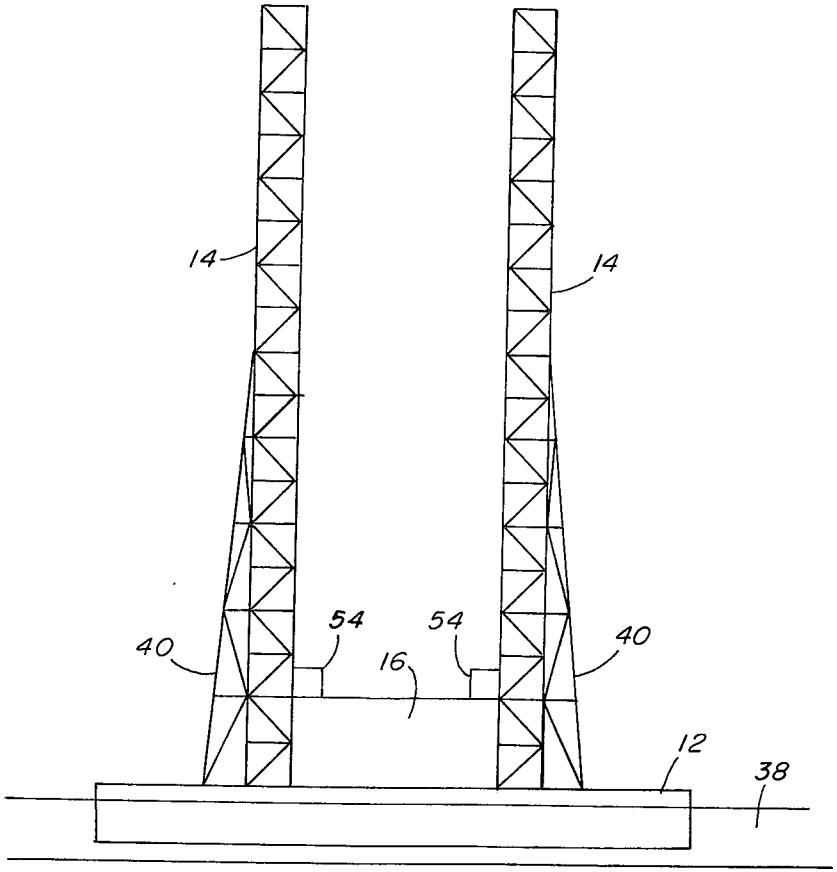

Construction of the platform assembly, as described above, continues, raising the deck as needed, until the partial leg structures 58 have reached a height in accordance with the requirements of the installation. The deck member is then lowered to a position adjacent the base member, the graving dock is flooded, and the platform assembly is floated by deballasting the base member (FIG. 8). In this position, the transportation mode, the platform assembly is towed to the installation site. The platform assembly, in this configuration advantageously has a low center of gravity which provides the assembly with a high degree of stability during transport.

Platform Installation

Figure 9:
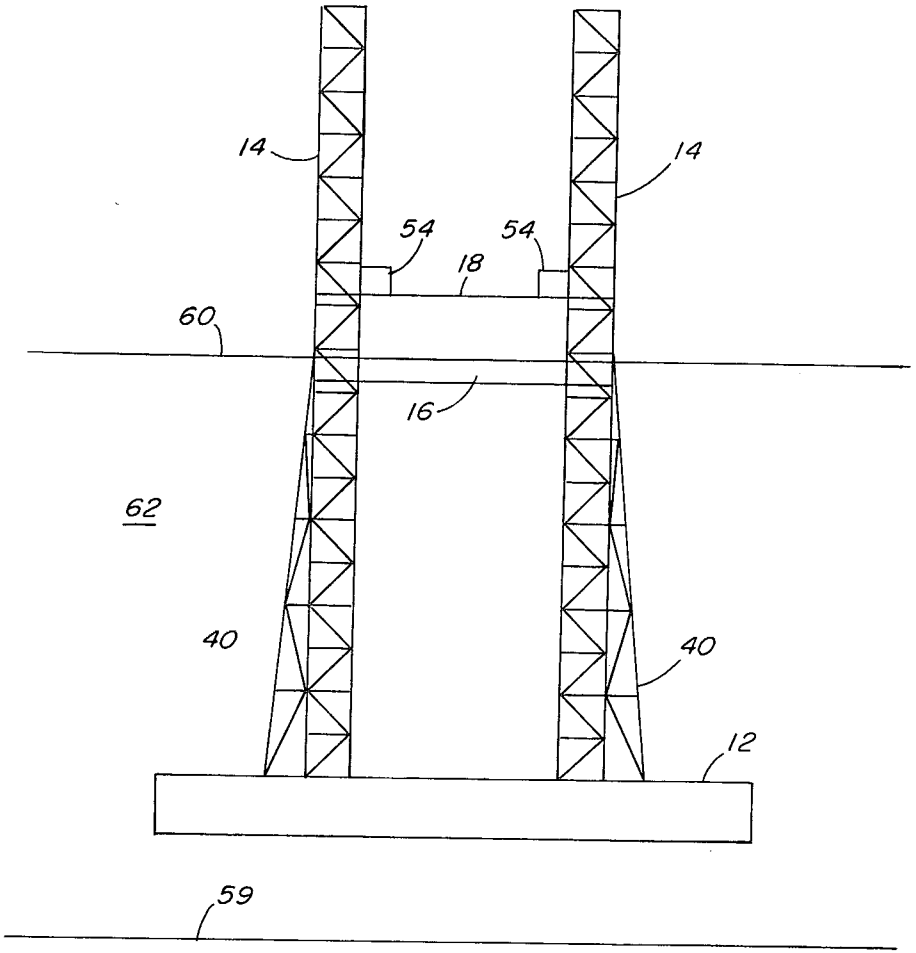
FIGS. 8–11 show in a sequence of schematic elevation views a method for towing and installing a mobile offshore platform according to the invention at a selected installation location.
Figures 10, 11, 11A:
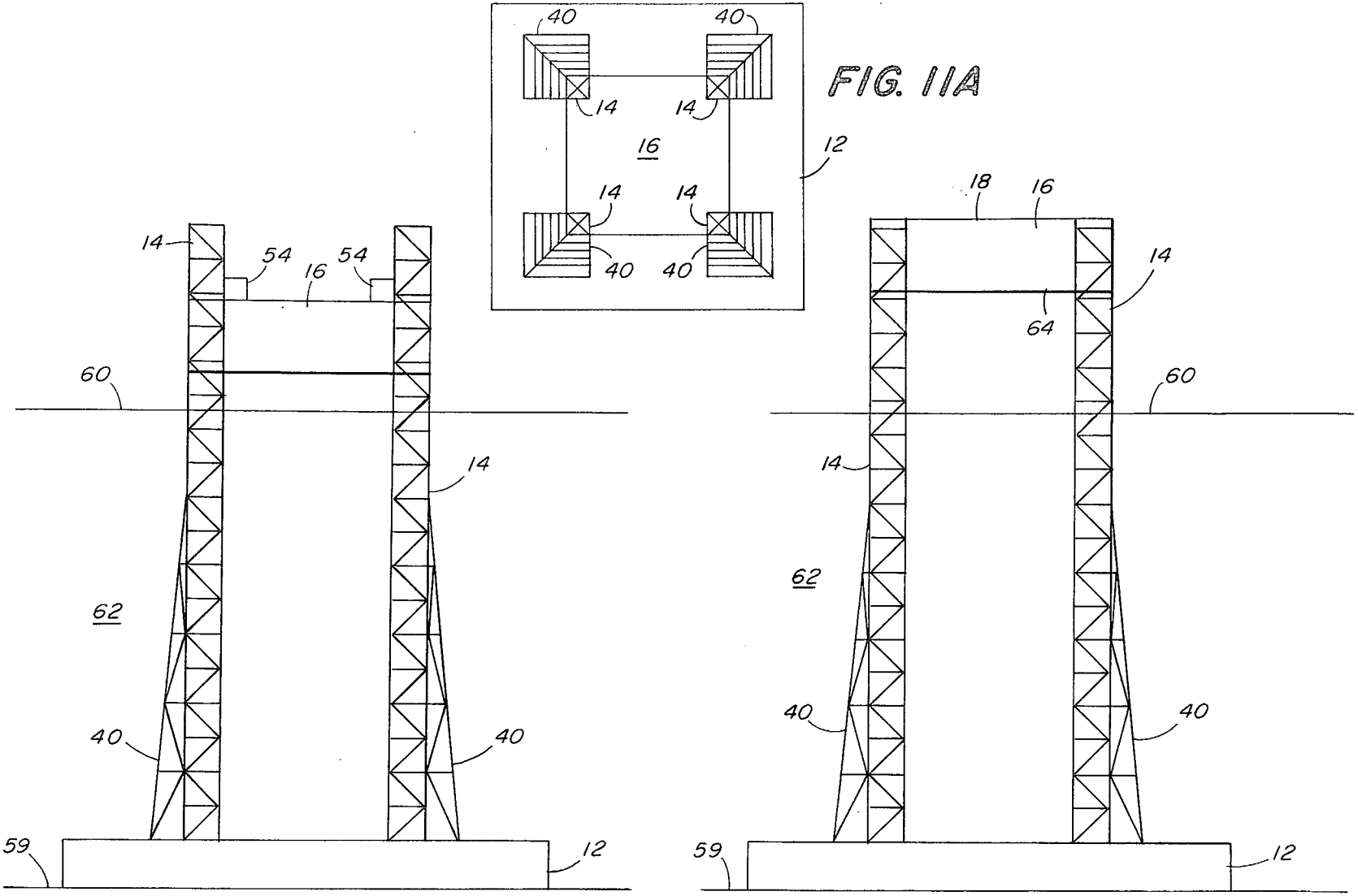
FIG. 11A is a top plan view of the embodiment of FIG. 11.

The platform is installed at the installation site as follows. Referring to FIG. 9, the fluid-tight compartment of base member 12 is ballasted wih sea water and is lowered, using jack elements 54 into an abutting engagement with the seabed 59. During the lowering operation, the spacing between the deck and base members increases, the deck member 16, either by itself or possibly in combination with temporary flotation members (FIGS. 15–17), provides the buoyancy necessary to maintain the upper work surface 18 of the deck member preferably above the upper surface 60 of the body of water 62. After the base member 12 contacts the bottom 59 of the body of water (FIG. 10), the deck member 16 is raised above the surface 60 of the body of water 62 to a height sufficient to be unaffected by the direct wave action of the water during for example a storm (FIG. 11). In this position, the leg structures 14 are preferably welded and secured to the deck member 16 (for example through a clamp element not shown) and jack elements 54 are removed from the deck for use in another location. Other methods for securing the deck member to leg structures 14 may also be used. Referring to FIG. 11, in a typical installation, a platform assembly installed in 400 feet of water, may have a bottom surface 64 of the deck member 16 one hundred feet above the mean surface water level and the topmost portion of the lateral support members, skirt frames 40, about 50 feet below the mean water surface level.

Each of the side elevation views of the platform assembly have been simplified for clarity by omitting many of the lateral support elements; and in particular, lateral support elements which extend normal to the plane of the drawing have been omitted. Referring to top plan view FIG. 11A, however, all of the skirt frames 40 are shown. As depicted there, frames 40 extend outward in orthogonal directions away from the deck member.

While the platform assembly is shown schematically in FIGS. 2–11, the platform will typically be supplied, during fabrication, with much of the necessary equipment and facilities to fully equip and test the deck member. In general, this obviates the need for derrick barges to supply equipment and materials during or after the installation procedure. Thus, the deck may be provided at the fabrication facility with the required heavy equipment and living facilities as well as conductor and pipeline equipment to enable the platform assembly to operate normally, substantially immediately, after installation is complete. In addition, riser members and conductors extending from the uppermost portion of leg structures 14 through the leg structures to the base member may also be provided onshore whereby additional time and money may be saved by standardizing these components and by installing them in a non-water environment. Thus, for example, the leg structures 14 may house or guide the riser and conductor elements of the platform assembly. These elements may be connected to or contained within the elongated truss-like leg structure of the preferred embodiment of the invention in a condition ready to be connected to the deck member once the deck member is secured in its operating position. Piling and other elements useful during the installation procedure may also be installed, on shore, in the leg structures.

The Low Platform Fabrication Method

Figure 12:
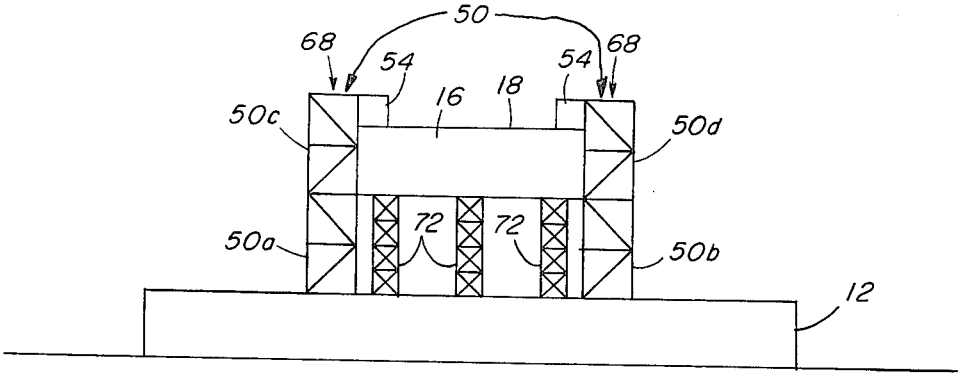
FIGS. 12–14 show in a sequence of schematic elevation views a portion of an alternative fabrication method for fabricating the mobile offshore platform according to the invention.
Figure 13:
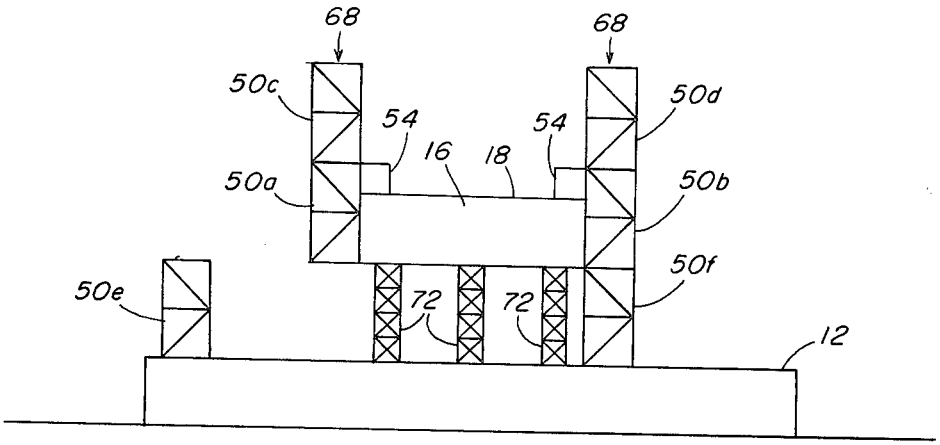
Figure 14:
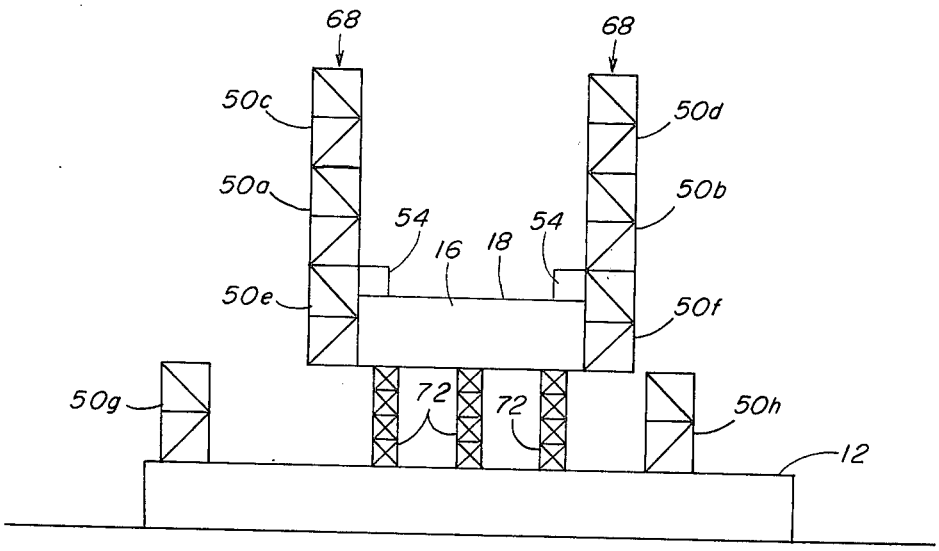

Referring now to FIGS. 12–14, according to an alternate particularly preferred fabrication method, the deck member is not raised substantially above the base member and the leg structures 14 are fabricated, not by adding leg sections 50 to the top of the partially completed leg structures, but by adding the leg sections to the bottom of partial leg structures. Referring to FIG. 12 (which resembles somewhat FIG. 6), after partially completed leg structures 68, each having two leg sections, have been fabricated, the deck is raised a distance preferably at least equal to the length of a single leg section 50 and temporary support structures 72 are provided beneath the deck member to support the deck member in a spaced apart relationship to the base member. Temporary supports 72 may be anchored temporarily to base 12 for stability and are generally elongate, open, truss-like members. Thereafter, the partial leg structures 68 are raised, using jack elements 54, a sufficient distance so that additional leg sections 50*e* and 50*f* may be secured to bottommost sections of the partial leg structures (FIG. 13). This process is continued (FIG. 14) adding leg sections (for example sections 50*g* and 50*h*) to the partially completed leg structures 68 until the entire leg support structure 14 is complete. The now completed leg support structures 14 are each secured to the base 12 of the platform assembly, for example, by welding. The deck member 16 is then raised a distance sufficient to enable the temporary support structures 72 to be removed. After the temporary support structures 72 have been removed, the deck is lowered to a position adjacent and preferably abutting base member 12 as shown in FIG. 8. Lateral support elements are then provided if necessary, and the platform is ready for transport to the installation site.

The Pass Through Structure and Installation

Figure 15:
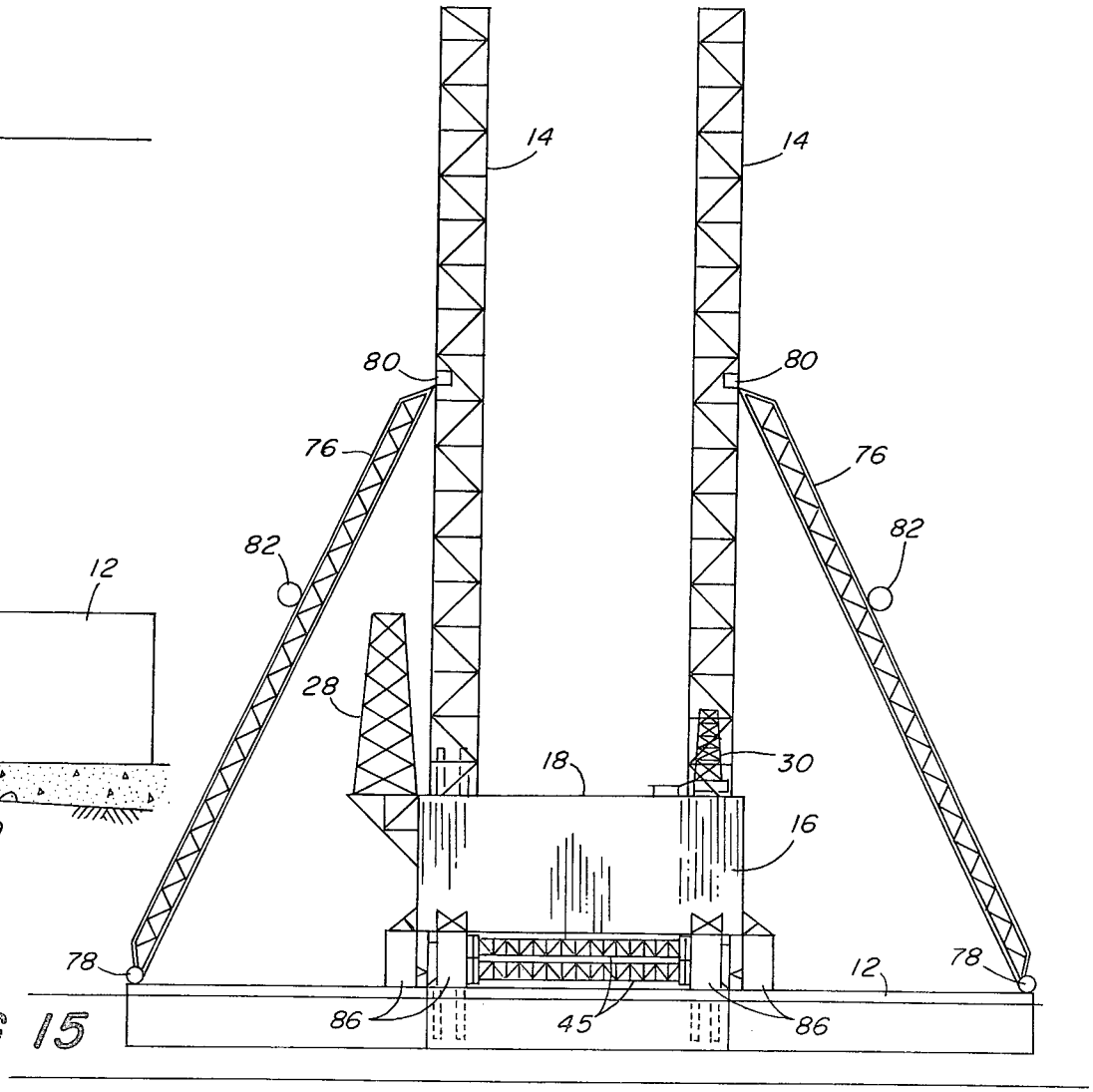
FIGS. 15–17 show a sequence of elevation views of an alternative construction of an offshore platform according to the invention and a method for installing it at a preselected offshore installation location.
Figure 16:
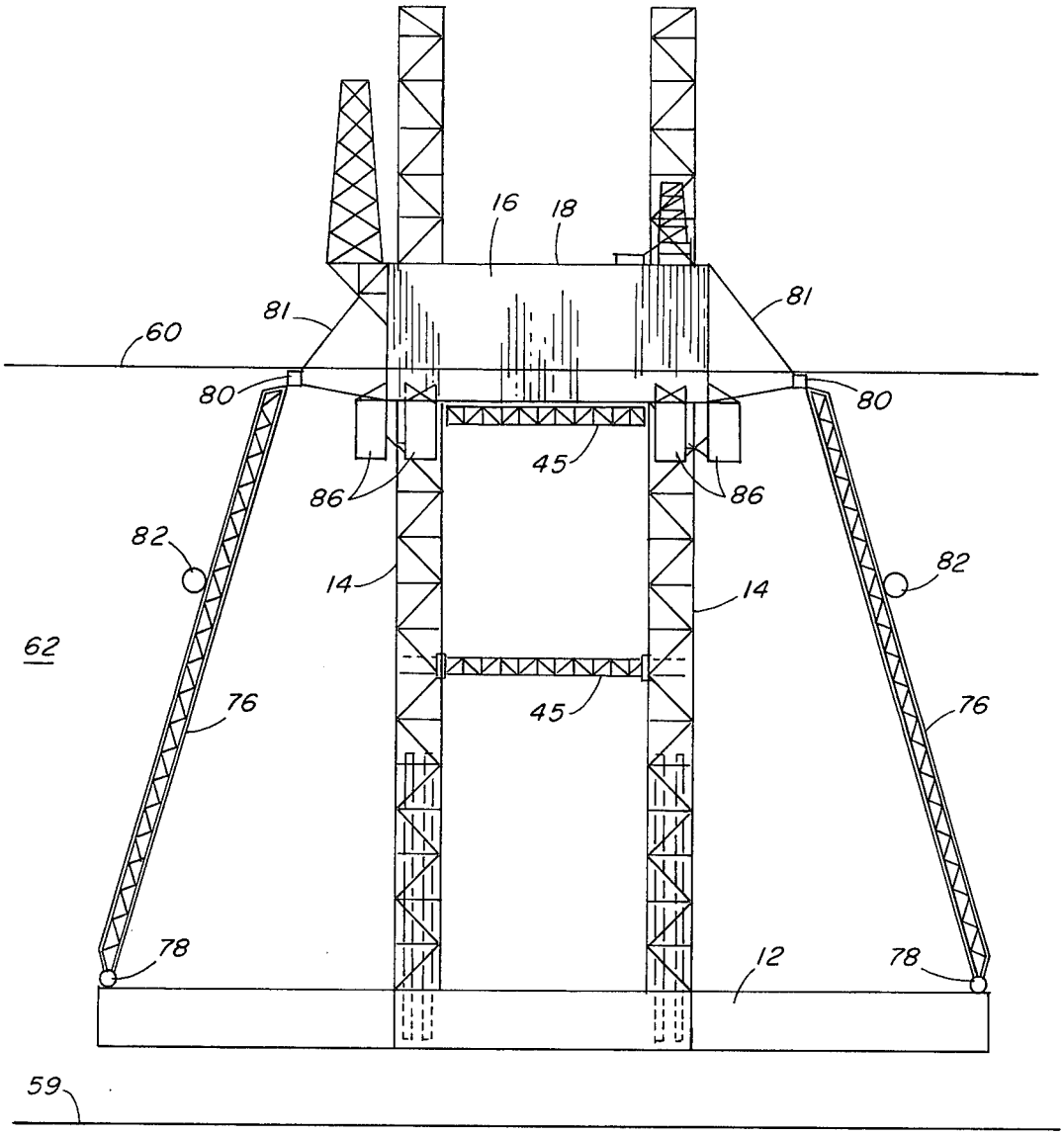

In another particular embodiment of the invention wherein leg structures 14 pass through (rather than around) the deck member, skirt frames 40 are replaced by side stays 76 (FIGS. 15–17). In this particular embodiment, deck member 16 is shown with a circular outside periphery and there is also shown in the figures some of the cross lateral supports 45.

As noted above, when the completed platform is towed from the graving dock, the deck member has installed thereon the equipment necessary to initiate normal operation when installation is complete. Thus, the deck member carries the flare tower 28, drilling rig 30, and the other necessary equipment most of which has been ommitted from FIGS. 15–17 for clarity.

Side stays 76 are connected between the leg structures 14 and base member 12 and are comprised of a generally elongated, open truss network. At base member 12, each side stay is preferably connected by a pivotable arrangement 78. Thus the side stays may be pivoted away from the leg structures during platform installation. During the transportation mode, that is, in the configuration in which the assembly is towed from the graving dock to the installation site (FIG. 15), the side stays 76 are connected to the leg structures 14 by a docking guide and lock mechanism 80. This mechanism allows the side stays to pivot in a controlled manner away from the deck member 16 in a first state (FIG. 16) and provides a secure lock mechanism to retain the side stays in position to resist lateral movement of the vertical leg structures in a second state (FIGS. 15 and 17).

Thus, as the base member 12 is lowered with respect to the deck member, there comes a time when the deck member passes the location at which side stays 76 are attached to leg structures 14 during the transportation mode. At an earlier time, the side stays are pivoted away from the leg structures, the position of the side stays being controlled by guide wires or flexible cables 81 connecting docking guide and lock mechanism 80 to the deck 16, so that the deck member may pass, in a non-interfering movement, the location at which the side stays are normally connected to the leg structures (FIG. 16). Each side stay preferably has secured thereto a removable flotation tank 82 to aid in pivoting side stays 76 away from deck member 16. Lateral cross support members 45, which interconnect the various leg structures 14, provide a stable and reliable assembly structure. The leg support structure, in its connection to base member 12, also helps prevent and offers a force resistant to vertical flexing of the substantially hollow base member.

After base member 12 has reached the seabed 59 (FIG. 17), side stays 76 are again connected directly to the leg structures 14 through docking guide and lock mechanism 80, and flotation tanks 82 are removed. In addition, if flotation elements 86 had been attached to the deck member to aid in maintaining the buoyancy of the entire platform while the base member was being lowered, they are also removed and deck member 12 is raised substantially above the surface level of the water. The deck member is then secured to the leg structures, for example, by welding, and the jack elements (not shown) are preferably removed.

With the platform fully assembled, shear piles 90, which in this particular embodiment are located within the leg structure 14 are driven into the submerged surface to provide an additional lateral stability to the platform. Shear piles 90 may also be driven into the submerged surface at an earlier time so long as the base member lies on the submerged surface.

Base Leveling Structure

Figure 18:
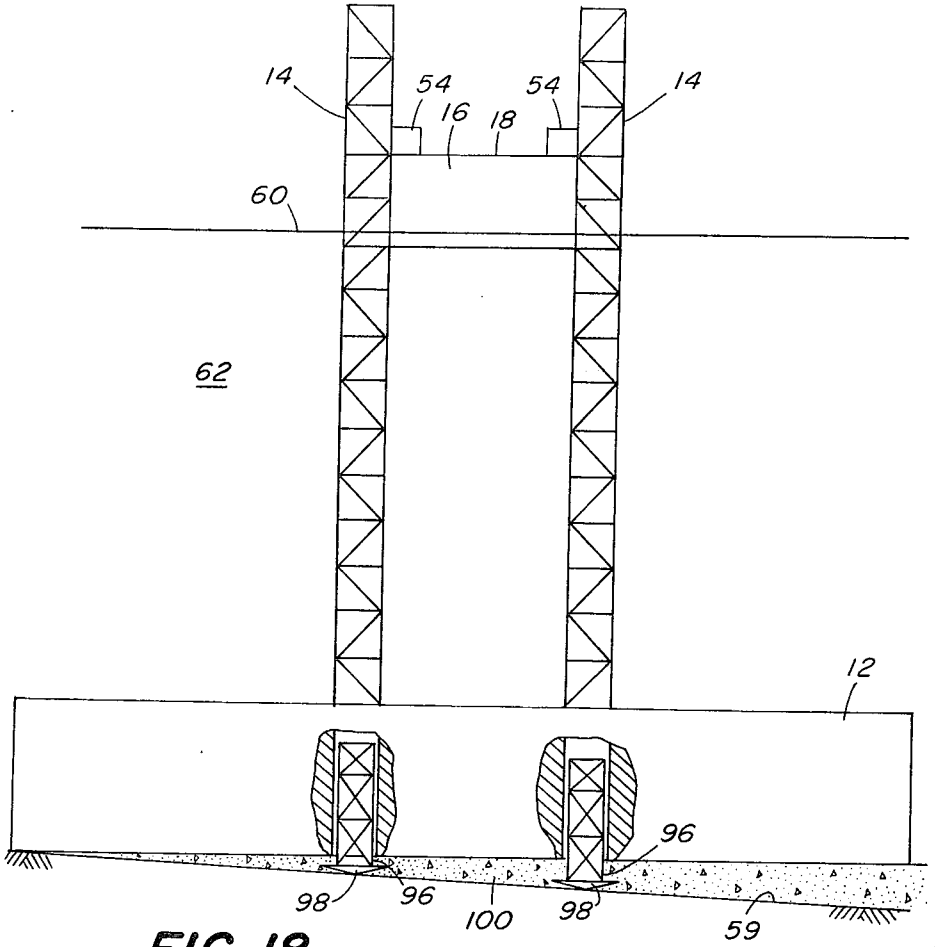
FIG. 18 is an elevation view of an embodiment of the invention wherein the base portion of the platform is leveled.

Referring to FIG. 18, in those instances where the water bottom 59 is not level with the horizontal or is not even, a plurality of leveling legs 96 are provided, preferably positioned within leg structures 14 to maintain the base member 12 and hence the entire platform assembly, in a plane parallel to the horizontal. In this particular embodiment, leveling legs 96 may each be positioned independently and are operatively connected to leg structures 14 so that the plane of the base member is shifted as leveling legs 96 are moved in a vertical direction. The bottom of each leveling leg is fitted with a leveling foot or pad 98 which has a large, preferably non-porous surface which will not sink significantly into the submerged surface 59 and which thus maintains a stable operating position.

Once the base 12 is aligned parallel to the horizontal, a hardenable material, for example, grout, is injected into the space 100 between the submerged base member 12 and the bottom of the body of water by means known in the art. Any other suitable hardenable material may also be used. In this manner, the entire weight of the platform is not maintained by the leveling pads 98 and the cement base provides a suitable support layer for the platform.

Additional Lateral Support Structure

In addition to the side stays and skirt frames discussed already, the platform assembly may also generally be provided, if needed, with cross supports 45 (FIGS. 15–17) to further strengthen the assembly to provide a stable, reliable, and safe platform. This additional support is connected to the leg structures so as not to interfere with movement of the deck member as it is moved upward along the leg structure. Thus, where the leg structures are located to intersect the plane defined by the deck member at points outside the outside periphery of the deck member, the cross support members may be secured prior to leaving the fabrication facility. On the other hand, where the leg structures pass through the deck member, the cross support members may be set in place as shown in FIG. 15 and may be raised and secured in position at a later time (FIGS. 16–17).

The Deep Water Multi-Tiered Structure

Referring to FIGS. 19–23, in those instances wherein a platform assembly is required to operate at great depths, for example 1500 feet or more, a multi-tiered platform assembly constructed and installed according to the invention may be used. In a preferred embodiment, the platform assembly has a pair of intermediate members 104, 106 and the resulting assembled structure looks very much like a multi-tiered wedding cake. In other embodiments of the invention, more or less intermediate members may be used. Base member 12 and each of the intermediate members 104, 106, have secured thereto leg structures 14 which are oriented substantially vertically, which may be interconnected by lateral interconnecting members 108, and which are constructed to cooperatively engage jack elements 54 (not shown) during the installation process.

Figure 19:
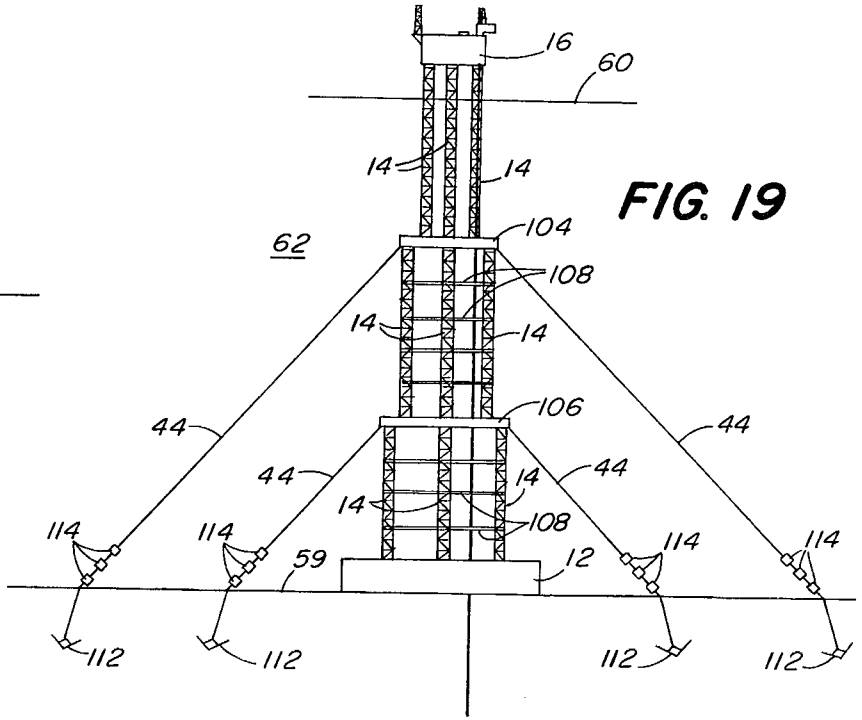
FIG. 19 is an elevation view of an embodiment of the invention which is particularly suited to deep water applications.
Figure 20:
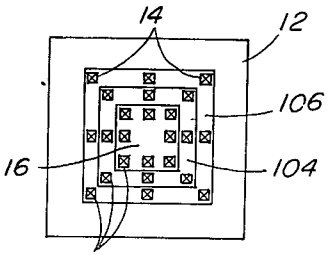
FIG. 20 is a plan view of the embodiment of FIG. 19.

Referring to FIG. 19, additional lateral stability and support may be provided to the multi-tiered platform by a lateral stabilizing means, for example, anchor cables 44 connected to the intermediate members and anchored in the submerged water bottom. The anchors 112 may be set in any convenient manner and are preferably driven into the submerged bottom by an active propellant. The anchor cables are typically provided with concrete weights 114 to partially absorb the energy of forces to which the anchoring system is subjected.

Figure 23:
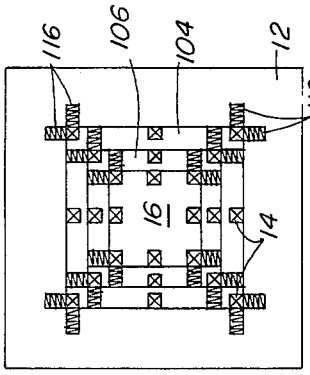
FIG. 23 is a plan view of the embodiment of FIG. 22.
Figure 22:
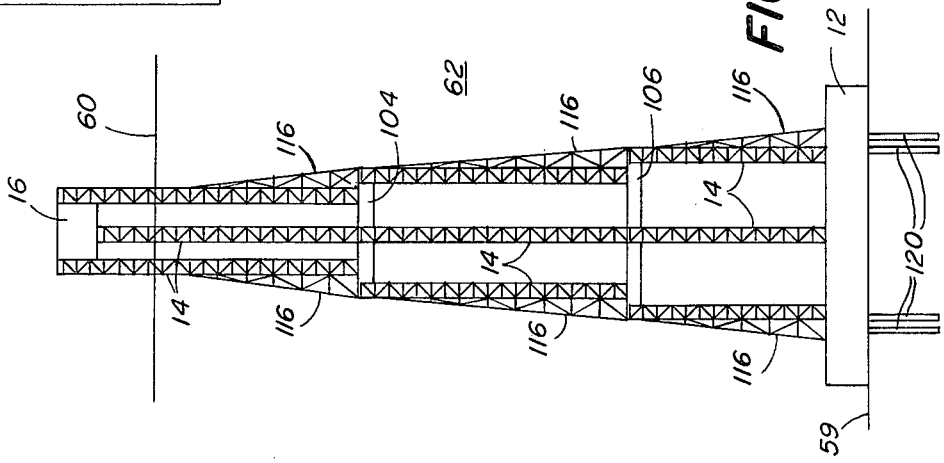
FIG. 22 is an elevation view of another embodiment of the invention particularly suited to deep water applications.

Alternatively, referring to FIGS. 22 and 23, additional lateral support may be provided to the multi-tiered platform by skirt frames 116. The skirt frames 116 are preferably installed at the onshore fabrication facility and provide additional lateral support in orthogonal directions although the skirt frames 116 normal to the plane of the sheet of drawings in FIG. 23 have been omitted for clarity.

Figure 21:
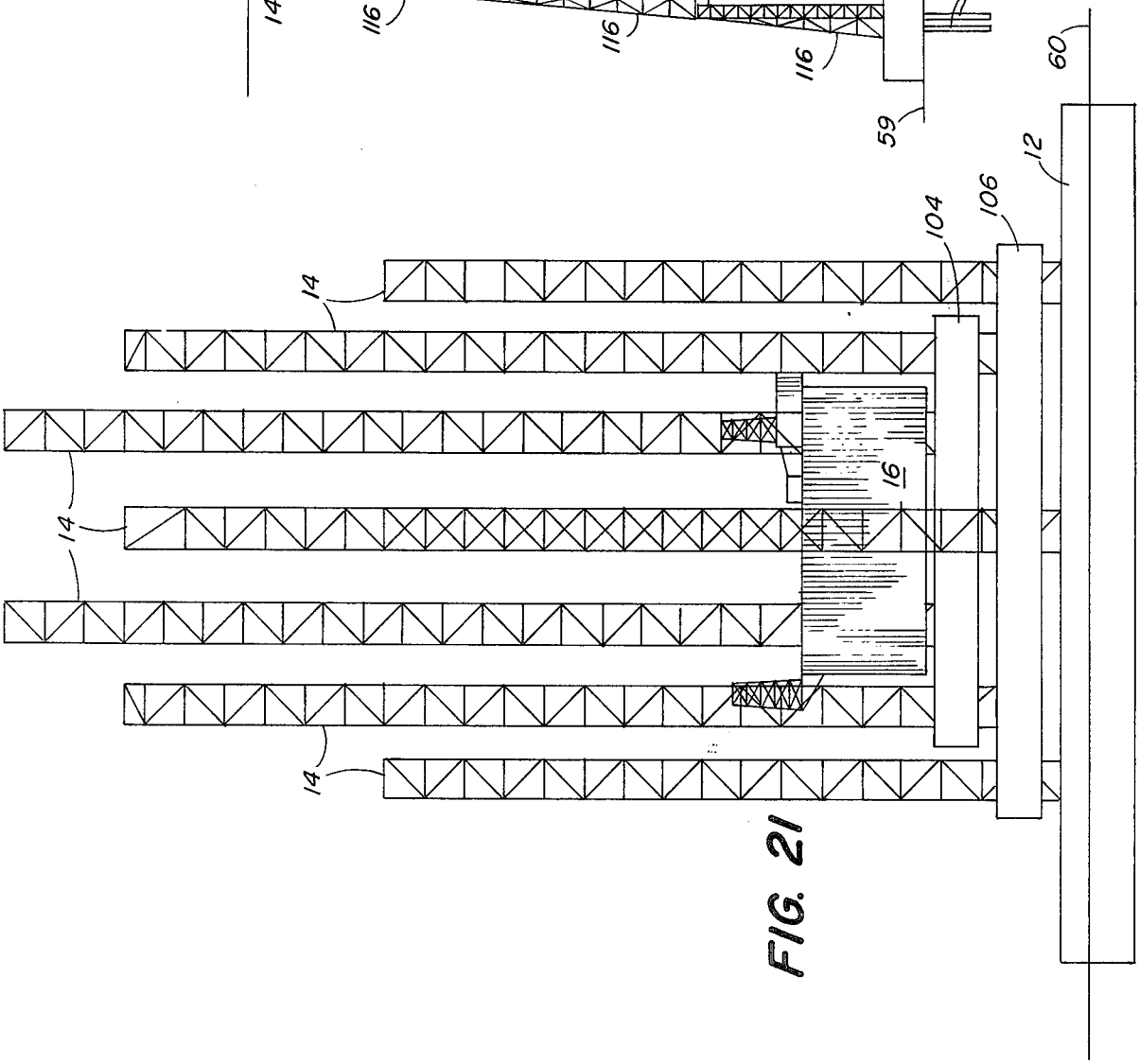
FIG. 21 is an elevation view of a collapsed, multi-tiered embodiment of the invention in the transportation configuration.

The multi-tiered platform is towed to the installation site in the collapsed state shown in FIG. 21 (all lateral support elements have been omitted for clarity). At the installation site, the multi-tiered platform is installed by lowering the base member 12, the lower intermediate member 106, and the upper intermediate member 104 in sequence.

In a preferred embodiment of the invention, only one set of removable jack elements 54 is needed to erect the assembly. The jacks are first secured to the lowest intermediate member to cooperatively engage at least a plurality of the leg structures 14 secured to the base member. The base member is then jacked down the length of the leg structures and the leg structures are secured to the lower intermediate member for example by welding. Buoyancy of the assembly during installation is preferably maintained by the intermediate members and the deck member. Means are provided to control the buoyancy of the various members. The jacks are then removed from the lower intermediate member and are transferred and secured to the upper intermediate member. The lower intermediate member (and the base member) are thereafter jacked down. The upper intermediate member is then secured to those leg structures 14 which are secured to the lower intermediate member. Buoyancy of the assembly is preferably now maintained by the upper intermediate member and the deck member. The jack elements are thereafter removed from the upper intermediate member and are transferred and secured to the deck member. The intermediate members and the base member are then lowered to the bottom of the body of water and the deck member is raised above the water surface. The deck is secured to those leg structures which are secured to the upper intermediate member and the jack elements are removed (for use elsewhere) to complete platform installation. The structures shown in FIGS. 19–23 may typically be used at depths up to and exceeding 1500 feet.

In an alternative installation procedure, removable jack elements may be provided on each intermediate member and the deck member at the onshore fabrication facility.

In the multi-tiered configuration just as in a configuration having no intermediate member, shear piles 120 may be carried by the outside leg structures secured to base member 12 and may be located, for example, within the leg structures. In any case, they may be driven into the submerged surface by a submersible pile driver to provide the platform assembly with additional lateral stability.

Figure 11C:
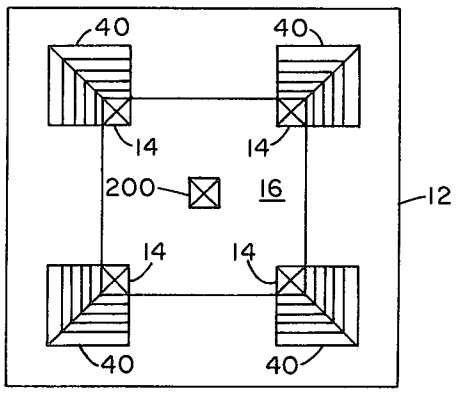
FIG. 11C is a top plan view of the embodiment of FIG. 11B.
Figure 11B:
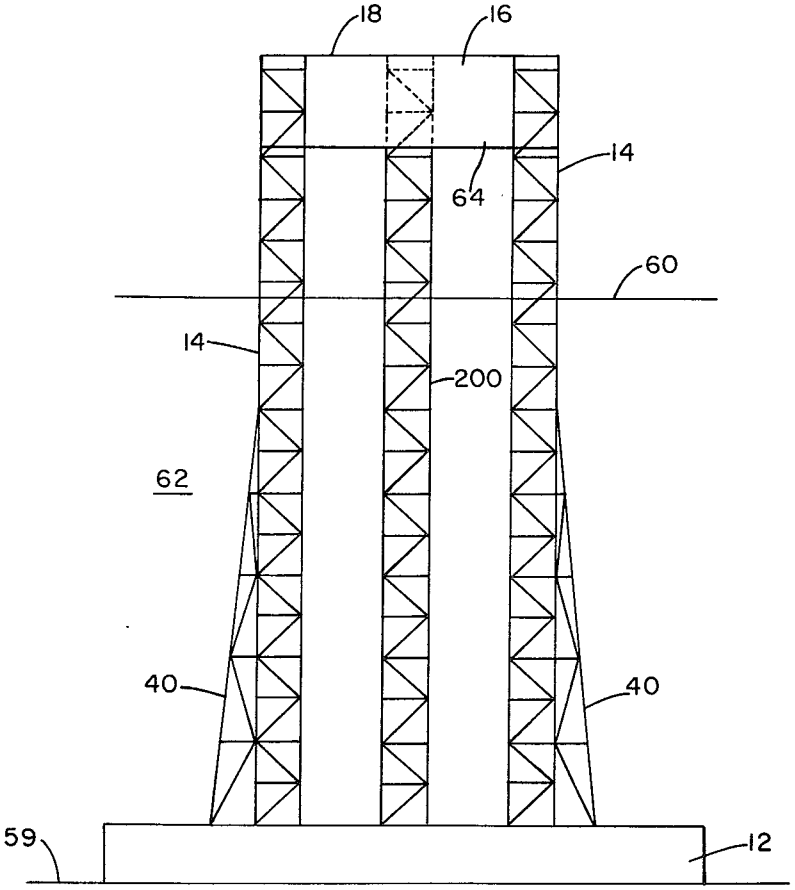
FIG. 11B is a schematic elevation view of an alternate configuration for a mobile offshore platform according to the invention.

In other embodiments, the offshore platform assemblies may be provided with a central truss-like elongated open leg support structure 200 (see FIGS. 11B and 11C. If used, the central leg structure is secured to the base member, passes through the central portion of the deck member and is preferably engaged, during fabrication and installation, by a corresponding jack element. The central leg structure may be load bearing and may be used to provide access to the deck member from the sea, to carry various pipelines to the submerged water bottom, and/or to support the conductors through which the drilling operations take place.

NONOBVIOUSNESS AND ADVANTAGES OF THE INVENTION

The use of jack-up, jack-down structures is well known. Thus, for example, Estes U.S. Pat. No. 3,385,069, issued May 28, 1968, Templeton, U.S. Pat. No. 3,001,370, issued Sept. 28, 1961, and French Pat. No. 1,366,164, published May 19, 1963, each describe a system using a gravity base member for stability.

Similarly, some other features of the invention are known. For example, Henry U.S. Pat. No. 2,210,408, issued Aug. 6, 1940, describes, a substantially obstruction-free work area, and a mobile platform using lateral supports is shown in Roussel U.S. Pat. No. 3,171,250, issued Mar. 2, 1965, and Loire U.S. Pat. No. 3,839,873, issued Oct. 8, 1974.

In addition, the use of shear piles in connection with the leg structures of a mobile platform is described in Schaufele U.S. Pat. No. 2,677,935, issued May 11, 1954, as well as Loire cited above. Other references have also described shear piles used in connection with the leg structures. Leveling leg structures are described in, for example, Moon U.S. Pat. No. 2,688,848, issued Sept. 14, 1954, Austrian Pat. No. 209,106, issued May 25, 1960, Italian Pat. No. 573,897, issued Mar. 5, 1958, and Schaufele cited above.

There are also references describing the use of a submerged base member for storing petroleum, for example, Rice U.S. Pat. No. 2,622,404, issued Dec. 23, 1952, and the use of driven shear piles as described, for example, in Mott et al U.S. Pat. No. 3,754,403, issued Aug. 28, 1973, and Castille U.S. Pat. No. 2,970,447, issued Feb. 7, 1961.

In addition to the patent literature, jack-up, jack-down structures have been described or pictured, for example, in the November, 1976 issue of *Ocean Industry* starting at pages 10 and 55; the May, 1977 issue of *Noroil* at page 28; in an advertising sheet prepared by Bethlehem Steel-Shipbuilding which bears the identifying notation Descr. Sheet 3234; in the April, 1977 issue of *Ocean Industry* at page 349; and in the May, 1977 issue of *Offshore* at pages 356–357.

Nevertheless, the claimed invention, which incorporates various features, some of which are found in the prior art, provides a uniquely advantageous offshore mobile platform assembly with significant potential to reduce cost by simplifying construction and installation. Thus, while various aspects of the invention may be known and used in the prior art it was not unitl they were combined with the other aspects of the invention claimed herein that a viable, practical, and acceptable structure evolved.

Thus, the invention is particularly advantageous by providing an offshore platform which can be fabricated onshore and wherein the necessary equipment to operate offshore are provided on the deck member prior to being towed to the installation site. In addition, the invention advantageously provides a method for standardizing various components of the platform by using the same type elements throughout even though the individual structures may in fact be different.

In addition, the invention advantageously provides a safe, reliable, stable system with a substantially uncluttered complete deck working surface, wherein, in one aspect, the leg support structures are placed outside the deck area in order to allow the deck to be moved in a non-interfering relationship with the leg structures and furthermore to provide as large an area as possible on the deck. Furthermore, several methods and structures of advantageously providing lateral support for leg structures are identified and claimed. These structures advantageously resist lateral movement and effectively, in combination with the leg structures, prevent or resist vertical flexing of the base member.

The claimed structure also advantageously distributes the load more uniformly throughout the base member than, for example, a single central support column.

The invention, in one aspect, further provides a method of fabrication of a mobile offshore platform assembly wherein the safety hazard is reduced by maintaining all of the construction elements except the vertical support legs at a relatively low elevation.

Other embodiments of the invention including other constructions of support legs, skirt frames, side stays, and base and deck members will be obvious to those skilled in the art. Those familiar with this disclosure and skilled in the art may recognize additions, deletions, substitutions and other modifications in addition to those suggested herein, all of which would be deemed to fall within the scope of the invention as set forth in the appended claims.

What is claimed is:

1. A mobile, offshore platform assembly comprising
a base member having a fluid-tight compartment,
means for adapting the fluid-tight compartment to store petroleum products,
said base member having sufficient buoyancy when said fluid-tight compartment is filled with a gas to be the prime buoyancy element of said platform assembly,
a deck member,
a plurality of open, truss-like, elongated support leg structures, said leg structures being permanently secured to the base member and having a substantially vertical orientation, and said legs being connected to the base member to provide a force resistant to vertical flexing of the base member,
each of the truss-like leg structures intersecting a plane defined by an upper-work surface of the deck member at positions not intersecting the work surface defined by the deck member,
said truss-like leg structures being positioned at the vertices of a polygon,
a plurality of jack elements secured around an outside periphery of the deck member and oriented to engage, substantially at the periphery, respective cooperating elements on said leg structures to vary the spacing between the deck and the base,
a plurality of lateral support means attached to said peripherally located support legs and spaced outward away from the deck to permit the deck to move in a non-interfering relationship with respect to the base member, and to provide a force resistant to lateral movement of the leg structures,
whereby said base can be lowered to engage a submerged water bottom and said deck can be raised above the water surface.

2. The offshore platform of claim 1 further including at least one detachable flotation assembly connected to the deck member for providing positive buoyancy to the platform assembly during lowering of the base member.

3. The offshore platform of claim 1 wherein said plurality of lateral support means comprise
a plurality of skirt frames, said frames attached to said peripherally located support legs at a plurality of spaced apart positions and spaced outward away from the deck to permit the deck to move in a non-interfering relationship with respect to the base member, and
each said skirt frame being secured at its bottom portion to the base member to provide a force resistant to lateral movement of the leg structures.

4. The offshore platform assembly of claim 1 further comprising
a central, elongated, open truss-like support leg structure secured to said base member and passing through said central work area of said deck member, and
a central jack element secured to said deck member and oriented to cooperatively engage a cooperating element on said central truss-like leg structure.

5. The offshore platform assembly of claim 1 further including leveling leg means carried by and secured to said leg structures for positioning said base in a horizontal orientation on the water bottom.

6. The offshore platform assembly of claim 5 further including
means for providing a hardenable material at an underside of said base member for filling any spaces between the base member and the submerged surface after the base is lowered to the submerged surface.

7. The offshore platform assembly of claim 6 wherein the hardenable material is grout.

8. The offshore platform assembly of claim 5 wherein said leveling means comprises a plurality of leveling legs, and further including means for independently moving each leveling leg vertically with respect to said base member.

9. The offshore platform assembly of claim 8 wherein each leveling leg is coaxial with and is positioned within a different support leg structure.

10. The offshore platform assembly of claim 1 further including means for rigidly securing said deck member to said leg structures.

11. The offshore platform assembly of claim 1 wherein said jack elements engage said leg structures through a leg structure moving means.

12. The offshore platform assembly of claim 1 wherein said deck member is substantially obstruction-free.

13. A mobile, offshore platform assembly comprising
a base member having a fluid-tight compartment,
means for adapting said fluid-tight compartment to store fluid petroleum products,
said base member having sufficient buoyancy when said fluid-tight compartment is filled with gas to be the prime buoyancy element of said platform assembly,
a deck member, said deck member having a substantially obstruction-free centrally located work area,
a plurality of open, truss-like, elongated support leg structures, said leg structures being permanently secured to said base member and having a substantially vertical orientation, and said legs connected to said base member to provide a force resistant to vertical flexing of the base member, each of said truss-like leg structures intersecting a plane defined by said work area at a position outside of said central work area, a plurality of jack elements secured around an outside periphery of said deck member and oriented to engage, substantially at said periphery respective cooperating elements on said leg structures to vary the spacing between said deck and said base, and a plurality of open, truss-like, elongated side stays connected between said base member and said leg structures to provide a force resistant to lateral movement of said leg structures, said stays having a docking and locking connection with said leg structures and said base whereby said stays are moveable from a first condition wherein they are in a non-interfering relationship to movement of said deck member along said leg structures and to a second condition wherein the stays are in an interfering relationship to movement of the deck member along the leg structure, whereby said base can be lowered to engage a submerged water bottom and said deck can be raised above the water surface.

14. The platform assembly of claim 13 further comprising a plurality of detachable flotation assemblies, each connected to a side stay.

15. The platform assembly of claim 13 further comprising at least one detachable flotation assembly connected to said deck member for providing positive buoyancy to said deck member during lowering of said base member to thereby support said assembly.

16. The offshore platform assembly of claim 13 further including leveling leg means carried by and secured to said leg structures for positioning said base in a horizontal orientation on the water bottom.

17. The offshore platform assembly of claim 16 further including means for providing a hardenable material at an underside of said base member for filling any spaces between the base member and the submerged surface after the base is lowered to the submerged surface.

18. The offshore platform assembly of claim 17 wherein the hardenable material is grout.

19. The offshore platform assembly of claim 16 wherein said leveling means comprises a plurality of leveling legs, and further including means for independently moving each leveling leg vertically with respect to said base member.

20. The offshore platform assembly of claim 19 wherein each leveling leg is coaxial with and is positioned within a different support leg structure.

21. The offshore platform assembly of claim 13 wherein said jack elements engage said leg structures through a leg structure moving means.

22. A multi-tiered mobile, offshore platform assembly comprising a base member having a fluid-tight compartment, a deck member, at least one intermediate member, each said member being arranged in a plane parallel to said deck member, a plurality of first open, truss-like, elongated support leg structures, said leg structures being permanently secured to said base member and having a substantially vertical orientation, at least one group of second open, truss-like, elongated support leg structures, the number of groups of second leg structures being equal to the number of intermediate members, each group of said second leg structures being permanently secured to a different intermediate member and having a substantially vertical orientation, at least one group of jack elements, said one group of jack elements secured to an intermediate member closest to the base member and oriented to engage respectively cooperating elements on said first support legs of the base member, and adapted to support said closest intermediate member in a spaced apart relationship to said base member and to vary the spacing between said closest intermediate member and said base member, each other intermediate member and said deck member, each having means to receive said jack elements and to secure them to said member in an orientation to engage respectively cooperating elements on the second support leg structures of the next lower intermediate member, to support said member in a spaced apart relationship with said next lower intermediate member and to vary the spacing between said member and said next lower intermediate member, whereby said base member can be lowered to engage a submerged water bottom, said deck member can be raised above the water surface level, and each said intermediate member is thereby submerged beneath the water surface at an intermediate water depth between said deck and said base member.

23. The platform assembly of claim 22 including lateral stabilizing means connected to said leg structures to reduce lateral movement of said leg structures.

24. The platform assembly of claim 23 wherein said lateral stabilizing means comprises guide wires connected between said legs and anchors embedded in the submerged water bottom.

25. The platform assembly of claim 23 wherein said lateral stabilizing means comprises a plurality of first skirt frames secured between said leg structures and said base member, and a plurality of groups of second skirt frames, the number of groups being equal to the number of intermediate members, and each skirt frame being connected between the leg structures secured to an intermediate member and said respective intermediate member.

26. The offshore platform assembly of claim 22 wherein said plurality of first leg structures defines a plurality of first longitudinal projections which each intersects planes defined by each of said intermediate members at positions outside of the surfaces respectively defined by said intermediate members, and each said group of second leg structures defines a plurality of second longitudinal projections which each intersects a plane defined by higher intermediate members at positions outside of the surface defined by said higher intermediate members.

27. The offshore platform assembly of claim 22 including means to make each said intermediate member positively buoyant.

28. A multi-tiered mobile, offshore platform assembly comprising a base member having a fluid-tight compartment, a first intermediate member, a second intermediate member, a deck member, a plurality of first open, truss-like, elongated support leg structures, said leg structures being permanently secured to said base member and having a substantially vertical orientation, a plurality of second open, truss-like, elongated support leg structures, said second leg structures being permanently secured to said first intermediate member and having a substantially vertical orientation, a plurality of third open, truss-like, elongated support leg structures, said third leg structures being permanently secured to said second intermediate member and having a substantially vertical orientation, a plurality of removable jack elements secured to said first intermediate member and oriented to engage respectively first cooperating elements on said first support legs and adapted to support said first intermediate member in a spaced apart relationship to said base member and to vary the spacing between said first intermediate member and said base member, means to receive said jack elements and to secure them to said second intermediate member in an orientation to engage respectively cooperating elements on said second support leg structures whereby said second intermediate member can be positioned in a spaced apart relationship to said first intermediate member and the spacing between said second intermediate member and said first intermediate member can be varied, and means to receive said jack elements and to secure them to said deck member in an orientation to engage respectively cooperating elements on said third support leg structures, whereby said deck member can be positioned in a spaced apart relationship with said second intermediate member and the spacing between said deck member and said second intermediate member can be varied, whereby said base member can be lowered to engage a submerged water bottom, said deck member can be raised above the water surface level, and said intermediate members are submerged beneath the water surface at intermediate water depths between said deck and said base members.

29. The platform assembly of claim 28 further including a plurality of second jack elements secured to said second intermediate member, and a plurality of third jack elements secured to said deck member.

30. A method of fabricating a mobile, offshore platform assembly which can be floated to an installation site from an onshore platform fabrication facility comprising the steps of fabricating a base member having a fluid-tight compartment, fabricating a deck member, positioning said deck member into an operational relationship with a top surface portion of said base member, at a predefined location, providing said deck member with a plurality of jack elements secured thereto and adapted to cooperatively engage each of a plurality of open, truss-like, elongated support leg structure sections, fabricating a plurality of leg structures from said leg sections by engaging a plurality of partial leg structures with said jacket elements, securing to each topmost leg section at its top portion, another leg section to form longer partial leg structures, raising the deck on said partial leg structures using said jack elements to aid in securing additional leg sections to topmost portions of said partial leg structures, and returning said deck to a position adjacent said base member.

31. The method of claim 30 wherein said positioning step includes the steps of floating said deck member over said base member, and lowering said deck member into said operational relationship with said top surface portion.

32. The method of claim 31 wherein said deck member is made positively buoyant and wherein said deck is lowered onto said base member by deflooding a graving dock.

33. The method of claim 31 wherein said lowering step includes the step of ballasting the deck member to a negative buoyancy state.

34. The method of claim 31 wherein said lowering step includes the step of deflooding the fabrication facility.

35. The method of claim 31 wherein said positioning step includes the step of skidding said deck member into position on said base member.

36. A method of fabricating a mobile, offshore platform assembly which can be floated to an installation site from an onshore platform fabrication facility comprising the steps of fabricating a base member having a fluid-tight compartment, fabricating a deck member, positioning said deck member into an operational relationship with a top surface portion of said base member at a predefined location, providing said deck member with a plurality of jack elements secured thereto and adapted to cooperatively engage each of a plurality of open, truss-like, elongated support leg structure sections, fabricating a plurality of leg structures from said leg sections by, engaging a plurality of partial leg structures with said jack elements, raising said deck on said partial leg structures, using said jack elements, a distance at least equal to the length of a leg section, providing a plurality of temporary support structures beneath said deck member, positioning and supporting said deck member on said temporary support structures, raising said partial leg structures using said jack elements a distance at least equal to the length of one of said leg sections, while maintaining said deck in a stationary position with respect to said base member, adding and securing additional leg sections to the bottommost portion of said partial leg structures, continuing to raise said partial leg structures and to add and secure said leg sections to fabricate longer partial leg structures, until said leg structures are complete, securing said bottommost leg sections to said base member, raising said deck member above said temporary support structures using said jacks and said leg structures, and removing said temporary support structures from beneath said deck member, whereby said deck member may be positioned adjacent to said base member.

37. The method of claim 36 wherein said first positioning step includes the steps of floating said deck member over said base member, and lowering said deck member into said operational relationship with said base member.

38. The method of claim 37 wherein said lowering step includes the step of ballasting the deck member to a negative buoyancy state.

39. The method of claim 37 wherein said lowering step includes the step of deflooding the fabrication facility.

40. The method of claim 36 wherein said temporary support structures each have a height at least equal to the length of a leg section.

41. The method of claim 36 wherein said first positioning step includes the step of skidding said deck member into position on said base member.

42. A mobile, offshore platform assembly comprising a base member having a fluid-tight compartment, means for adapting the fluid-tight compartment to store petroleum products, said base member having sufficient buoyancy when said fluid-tight compartment is filled with a gas to be the prime buoyancy element of said platform assembly, a deck member having a substantially obstruction-free upper work surface, a plurality of open, truss-like, elongated support leg structures, said leg structures being permanently secured to the base member and having a substantially vertical orientation, said legs being connected to the base member to provide a force resistant to vertical flexing of the base member, and each of said leg structures intersecting a plane defined by said work surface at positions along an outer periphery of the obstruction-free work surface, said truss-like leg structures being positioned at the vertices of a polygon, a plurality of jack elements secured to the deck member and oriented to engage respective cooperating elements on said leg structures to vary the spacing between the deck and the base, a plurality of lateral support means attached to said support legs to provide a force resistant to lateral movement of the leg structures, whereby said base can be lowered to engage a submerged water bottom and said deck can be raised above the water surface.

43. The platform assembly of claim 42 further comprising a central, elongated, support leg structure secured to said base member and passing through a central portion of said deck member.

44. A method of fabricating, at an onshore platform fabrication facility, a mobile, offshore platform assembly which can be floated to an installation site from said onshore platform fabrication facility comprising the steps of fabricating a base member having a fluid-tight compartment, fabricating a deck member, positioning said deck member into an operational relationship with a top surface portion of said base member at a predetermined location, providing said deck member with a plurality of jack elements secured thereto and adapted to cooperatively engage each of a plurality of open, truss-like, elongated support leg structure sections, fabricating at said onshore facility a plurality of leg structures from said leg sections by engaging a plurality of partial leg structures with said jack elements, securing to each partial leg structure additional leg sections to form longer partial leg structures, positioning the deck member relative to said partial leg structures using said jack elements to aid in securing additional leg sections to said partial leg structures, and returning said deck member to a position adjacent said base member while leaving said resulting leg structures in a fabricated condition.

45. The method of claim 44 wherein said first positioning step includes the steps of floating said deck member over said base member, and lowering said deck member into said operational relationship with said top surface portion of said base member.

46. The method of claim 44 wherein said first positioning step includes the step of skidding said deck member into position with said top surface portion.

* * * * *